United States Patent [19]

Carbonel

[11] Patent Number: 4,538,538

[45] Date of Patent: Sep. 3, 1985

[54] STABILIZING APPARATUS FOR A CRAFT

[76] Inventor: Claude Carbonel, 1 Rue Farjon, 13001 Marseille, France

[21] Appl. No.: 348,367

[22] Filed: Feb. 12, 1982

[30] Foreign Application Priority Data

Feb. 13, 1981 [FR] France ..... 81 03038

[51] Int. Cl.[3] ..... B63B 43/06

[52] U.S. Cl. ..... 114/125; 114/289

[58] Field of Search ..... 114/125, 288, 289, 290, 114/56, 343, 355, 356, 357, 358; 440/68

[56] References Cited

U.S. PATENT DOCUMENTS

| | | | |
|---|---|---|---|
| 3,085,535 | 4/1963 | Hunt | 114/56 |
| 3,361,104 | 1/1968 | Glass | 114/290 |
| 3,559,222 | 2/1971 | Walker | 9/6 |
| 4,048,939 | 9/1977 | Jones | 114/125 |

FOREIGN PATENT DOCUMENTS

| | | | |
|---|---|---|---|
| 273155 | 6/1965 | Australia | 114/56 |
| 409797 | 4/1910 | France . | |
| 2425372 | 12/1979 | France . | |

*Primary Examiner*—Sherman D. Basinger

*Attorney, Agent, or Firm*—Sandler & Greenblum

[57] ABSTRACT

A craft having a stabilizing device including a triangular, substantially flat, base floor having a bottom on which the craft floats when at rest and forming the top of the stabilizing device, and a V-shaped hull with sides connected to the flat base floor and extending below the bottom of the floor to form the sides of the stabilizing device, with the flat base floor bottom extending from one side to the other side of the V-shaped hull to define a space which extends completely across the bottom of the floor and is fully open at the rear of the craft so that the space is substantially filled with water when the craft is at rest.

6 Claims, 8 Drawing Figures

STABILIZING APPARATUS FOR A CRAFT

BACKGROUND OF THE INVENTION

1. Field of the Invention

The present invention relates to stabilizing apparatus for craft. More particularly, the present invention is directed to a stabilizing apparatus designed for boats having a V-shaped hull which function to assure and enhance their stability when at rest or merely floating on the water when not under power.

2. Material Information Disclosure

The hulls of conventional craft are normally designed to have a tunnel or water-ballast device implanted along the keel or in the hull of the craft to provide a stabilizing effect. Such conventional stabilizing means may take the form of a tubular element provided with a wide opening at the rear of the boat and a vent hole in its front.

In order to be effective, however, such equipment must cause an increase in the displacement of water by the boat or craft. Consequently, as the ballast tube becomes laden with water, the boat becomes heavier and sinks deeper in the water. Thus, when the boat is at rest it can no longer avoid the effect of waves which readily wash over the gunwales and into the boat.

Moreover, the ballast device acts as a longitudinal axis that fascilitates the tipping or lateral overturning of the craft. This is due in part to the fact that the tunnel tends to raise the center of gravity of the boat which results with a general loss of stability.

Furthermore, the water contained in the ballast tunnel does not empty immediately upon startup, but rather only after the boat has been propelled to considerable speeds. Consequently, displacement of water from the tunnel requires a significant expenditure of energy.

On the other hand, if one stops the propulsion of the boat in the course of start-up, the water remaining in the partially empty tunnel rapidly moves to the front of the craft causing its nose or bow to dip or drop towards the water. In order to prevent water from washing into the boat, the sides at the front of the boat must be higher than would otherwise be required and, therefore, adds additional weight to the craft.

SUMMARY OF THE INVENTION

The stabilizing apparatus in accordance with the present invention overcomes these disadvantages.

It is an object of the present invention to provide a craft having V-shaped hulls with an apparatus which confers stability to the craft when at rest similar to that which is exhibited by flat-bottomed boats while permitting the craft to retain the maneuverability and responsiveness of the V-shaped hull.

It is another object of the present invention to provide a stabilizing apparatus which is made up of the base floor of the boat which is essentially flat and has a triangular configuration or shape under which is positioned a container or tunnel having a triangular cross-section in both horizontal or vertical planes which is fully open at its rear.

It is yet another object of the present invention to provide a stabilizing apparatus positioned beneath the substantially flat, triangular shaped, base floor in the shape of a prism or pyramid, the volume and width of which becomes progressively smaller towards the bow of the boat into a duct which extends along the prow to the upper portion of the bow and opens to the atmosphere through a vent hole.

BRIEF DESCRIPTION OF THE DRAWINGS

The attached drawings depict surface water craft or boats which illustrate, as a non-limiting example, one way in which the objects of the present invention may be accomplished.

DESCRIPTION OF THE PREFERRED EMBODIMENT

Figure 4:
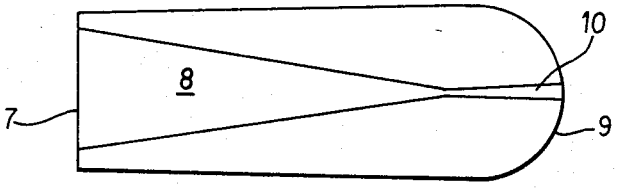
FIGS. 4 and 5 are planar and perspective views, respectively, of the bottom of the craft, showing the V-shaped profile of the triangular cross-section of the stabilizing apparatus of the present invention.
Figure 5:
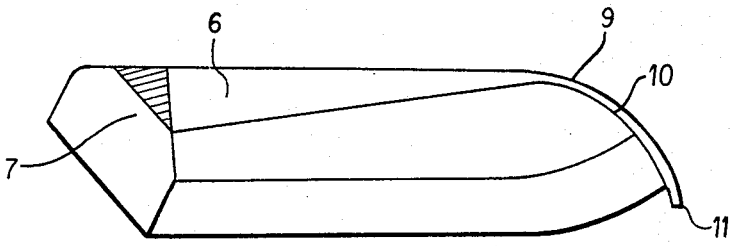

Craft 1 includes a V-shaped hull and an oblique floor 2 inclined from the rear or stern 3 to the front or bow 4 of the craft. The floor is water-proof and has a triangular shape which forms the substantially flat base or bottom of the boat. Together with the sides of the V-shaped hull, the substantially flat and triangular-shaped base floor forms a container 6 having a triangular cross-section 7 which is completely open at its rear towards the bottom of rear panel or stern 5 of the craft. As can be seen more clearly in FIGS. 4 and 5, this container is in the shape of a pyramid or prism having a triangular cross-section with diminishing volume so that its terminal point 4 extends as a duct 10 along the profile of the prow 9 opening to the atmosphere by a vent hole 11. The duct can also serve as a chain shaft.

As a result of the design of the stabilizing apparatus of the present invention, the water which fills container or tunnel 6 when the craft is stationary, circulates freely therein but is maintained at a constant volume.

Figure 1:
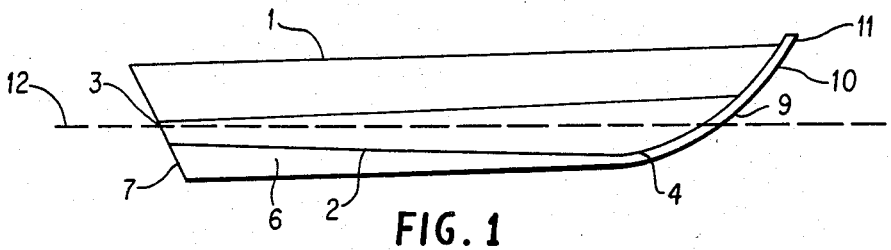
FIG. 1 represents an elevational view and profile view of the V-shaped hull.
Figure 2:
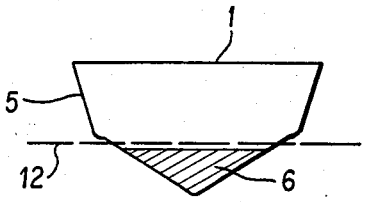
FIGS. 2 and 3 show elevational views of the front and back surfaces of the boat.
Figure 3:
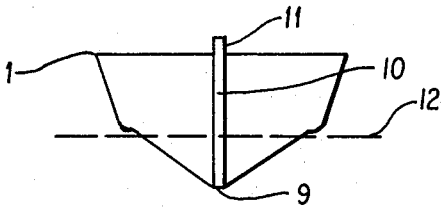
Figure 6:
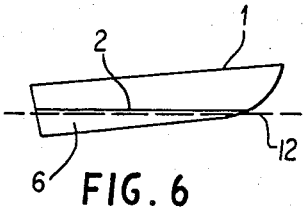
FIGS. 6, 7 and 8 represent the positions assumed by the craft equipped with the stabilizing apparatus of the present invention at rest, during start-up, and while planing, respectively, so as to illustrate the relative displacement of water by the craft.

FIGS. 1 and 6 show the craft or boat at rest as floating in the water on its flat base floor. Despite the fact that the container or tunnel 6 is completely filled with water, the craft or boat floating on its base floor only displaces its own weight in the water which is not affected by the water within container 6. When at rest, therefore, the craft exhibits stability similar to that of a flat-bottomed boat as a result of floating on its substantially flat base floor.

Figure 7:
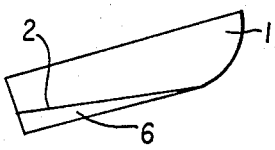

Notwithstanding that container or tunnel 6 is filled with water, the water does not act as ballast as it does in conventional water-ballast devices. Such devices function in such a way so as to cause what may be referred to as a floating anchor effect. This is caused by the rear of the V-shaped hull dipping into the water as a result of the force of the displacement of water towards the rear base of the V-shaped hull in reaction to the forward movement of the boat. In contrast, the stabilizing apparatus of the present invention tends to suppress the floating anchor effect. This is more clearly illustrated in FIG. 7 which shows the start-up of the boat. The boat is also shown as moving from a position of stability resulting from the boat floating on its substantially flat base floor when at rest, to a posture having dynamic stability of lift due to the profile of the V-shaped hull. In so doing, the water actually stays in place, rather than being evacuated from the container. In effect, it is the craft or boat which leaves the water as it begins to plane. In view of the manner in which the craft equipped with the stabilizing apparatus of the present invention is permitted to function, all of the elements which contribute to water functioning as a ballast are eliminated during operation of the craft.

In addition, the secondary effects caused by friction or turbulence of the water within the container are substantially eliminated. This is due in part to the vent hole 11 which serves to prevent an air pressurization or depressurization from occuring within the container which would otherwise disturb the water contained therein.

Figure 8:
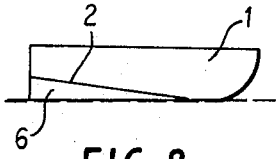

Furthermore, the stability of the craft when running is assured by the lift provided by the V-shaped hull as shown in FIG. 8.

The shapes, dimensions and arrangements of the elements in accordance with the present invention can vary, just as the materials used in the fabrication of the craft without resulting with a change in the general conception of the invention previously described.

It is understood that the present disclosure of the preferred form has been made only by way of example, and numerous changes in the detail of construction may be reverted to without departing from the scope of the invention hereinafter claimed.

I claim:

1. A craft having a stabilizing device comprising:

a triangular, substantially flat base floor, said floor having a bottom on which said craft floats when at rest and forming the top of said stabilizing device; and a V-shaped hull having sides connected to said flat base floor and extending below said bottom of said floor to form the sides of said stabilizing device, said flat base floor bottom extending from one side to the other side of said V-shaped hull, said flat base floor and said sides of said V-shaped hull defining a space extending completely across the bottom of said floor and being fully open at the rear of said craft so that said space is substantially filled with water when said craft is at rest.

2. The device of claim 1 wherein said space defined by said flat base floor and said sides is elongated in the general direction of said craft and extends with a progressively diminishing volume towards the front of said craft.

3. The device of claim 2, wherein said space has a triangular shape.

4. The device of claim 3, wherein said space is essentially triangular in cross section from the rear to the front of said craft.

5. The device of claim 4, wherein said space is in the shape of a pyramid.

6. The device of claim 5, wherein said space terminates as a duct communicating with a vent that opens to the atmosphere at the upper portion of the prow of said craft.

* * * * *